US005540517A

United States Patent [19]

Varosh

[11] Patent Number: 5,540,517

[45] Date of Patent: Jul. 30, 1996

[54] PYROTECHNIC PATTY AND METHOD FOR ATTACHING PAVEMENT MARKERS

[75] Inventor: Ronald E. Varosh, Danville, Calif.

[73] Assignee: Reynolds Industries Systems, Incorporated, San Ramon, Calif.

[21] Appl. No.: 450,694

[22] Filed: May 25, 1995

[51] Int. Cl.[6] ..... E01F 9/06

[52] U.S. Cl. ..... 404/12; 404/13; 156/71

[58] Field of Search ..... 404/9, 10, 12, 404/13, 14, 16; 116/63 A, 63 R; 362/153.1; 156/71

[56] References Cited

U.S. PATENT DOCUMENTS

| | | | |
|---|---|---|---|
| 3,575,092 | 4/1971 | Freeman | 404/14 X |
| 3,590,052 | 5/1975 | Broeck . | |
| 3,864,052 | 2/1975 | Blomberg | 404/94 |
| 3,980,393 | 9/1976 | Heasley et al. . | |
| 4,035,059 | 7/1977 | DeMaster | 404/9 X |
| 4,145,112 | 3/1979 | Crone et al. | 404/14 X |
| 4,623,280 | 11/1986 | Stenemann | 404/94 |
| 4,634,310 | 1/1987 | Clarke | 404/15 |
| 4,815,890 | 3/1989 | Duncan | 404/15 |
| 4,887,741 | 12/1989 | Downing . | |
| 4,936,485 | 6/1990 | Downing . | |
| 4,974,990 | 12/1990 | Anderson et al. | 404/94 |
| 5,108,217 | 4/1992 | Bloom | 404/10 |
| 5,310,278 | 5/1994 | Kaczmarczik et al. | 404/14 |
| 5,316,406 | 5/1994 | Wyckoff | 404/12 |

OTHER PUBLICATIONS

*Hawley's Condensed Chemical Dictionary,* Twelfth Edition, Van Nostrand Reinhold, 1993, p. 1036.

Bailey, A. et al., "Explosives, Propellants and Pyrotechnics," London, Washington: Brassey's 1989, pp. 115–120.

Conklin, J., "Chemistry of Pyrotechnics: Basic Principles and Theory," New York: Marcel Dekker, Inc., 1985, pp. 26–27, 49–81.

Varoth, R. et al., "Development of a Method of Fastening Reflectors to Highway Surfaces," RISI Letter Report Oct. 18, 1993.

Sun, S. et al., "An Investigation of New Marker Adhesive Processes for Botts' Dots," AHMCT Research Report UCD–APR–94–01–31–01, Jan. 31, 1994.

Varosh, R, "Proposal for an Extension of An Investigation of New Marker Adhesive Process for Botts' Dots," Feb. 1994.

Varosh, R., "Pyrotechnic Fastening of Reflectors to Highway Surfaces," RISI Letter, Feb. 2, 1994.

*Primary Examiner*—George A. Suchfield

*Attorney, Agent, or Firm*—Pretty, Schroeder, Brueggemann & Clark

[57] ABSTRACT

A pyrotechnic patty for rapidly attaching a raised pavement marker to a paved roadway surface is disclosed. The pyrotechnic patty consists of a stable mixture of oxidizer and fuel formed into a fattened shape that, once ignited, deflagrates rapidly producing a large amount of heat. The heat melts an adhesive pad that, after cooling and solidifying, permanently attaches the pavement marker to the paved surface. Preferably, the adhesive pad is formed of bitumen and the pyrotechnic patty is formed of a composition, in predetermined proportions, of potassium nitrate, aluminum nitrate, shredded newspaper, aluminum, and sulfur. The pyrotechnic patty is controllably ignited by passing an ignition current through a nichrome wire. The pyrotechnic patty is particularly suitable for use in an automatic marker attachment system.

15 Claims, 2 Drawing Sheets

PYROTECHNIC PATTY AND METHOD FOR ATTACHING PAVEMENT MARKERS

BACKGROUND OF THE INVENTION

This invention relates generally to the attachment of pavement markers to a paved roadway surface, and, more particularly, to the attachment of raised pavement markers to a paved surface by melting an adhesive pad using a pyrotechnic patty.

Modern roadway construction includes, as a safety feature, the installation of raised pavement markers 10, shown in FIG. 1, at selected intervals along the lane-divider lines of a surfaced roadway. The pavement markers may have a variety of shapes and sizes, depending upon their location and desired effect. One common lane or pavement marker, the "Bott's Dot," is a circular ceramic disk having a generally flat bottom surface and a domed upper surface. The diameter of the disk is about 4 inches and the height of the disk at the crown of the domed surface is about ¾ inch. Alternatively, the pavement maker may have a square or rectangular shape and may include a retro reflective plastic covering.

Several techniques are used for attaching the pavement markers 10 to a paved surface 12. Initially, epoxy was the favored adhesive for attaching the markers to the roadway surface. However, epoxy is slow to cure, requires closure of the affected lanes for an extended time period, and is subject to failure if mixed in an improper proportion. A technique that currently is favored uses bitumen 14, a tar-like substance that solidifies quickly and has high shear strength, especially at mid to low temperatures, as an adhesive for attaching the markers to the roadway surface.

Bitumen is specified as a mixture of about 25–35% by weight of asphalt and about 65–75% by weight of calcium carbonate. To attach the pavement marker 10, a small puddle of molten bitumen 14 is poured onto the roadway surface 12 and the pavement marker is placed in the puddle. The bitumen is allowed to cool and solidify, to form a strong bond between the pavement marker and the roadway surface. To be applied in its molten state, the bitumen must be heated to a temperature above 204° C. which creates operational and worker safety problems. Often, a propane-heated tank of molten bitumen must be towed to the attachment site and installation might be further delayed since approximately two hours is required for a propane heater to heat the bitumen to its melting point. Also, the bitumen is messy, tends to foul automated equipment, and often solidifies in delivery hoses if the process is interrupted.

Accordingly, there is a need for an attachment device and method that can attach a raised pavement marker to a roadway surface in a relatively safe, efficient, and economical manner, and that may be suitable for incorporation in an automatic attachment system. The present invention satisfies this need.

SUMMARY OF THE INVENTION

The present invention is embodied in a pyrotechnic patty for attaching a pavement marker to a paved surface by heating an adhesive pad. The pyrotechnic patty includes one or more oxidizers and one or more fuels, which are blended and formed into a relatively flat patty. The compositions and amounts of the oxidizers and fuels are such that, upon ignition, the patty is effective in melting the adhesive pad while producing a sufficiently low amount of residual ash so that the pavement marker is adequately attached to the paved surface. The pyrotechnic patty also may include constituents that function primarily as temperature and burn rate modifiers.

In one effective composition of the pyrotechnic patty, the oxidizers and the fuels are comprised of the following constituents, in approximate weights:

1.5 grams of potassium nitrate;

7.0 grams of ammonium nitrate;

4.8 grams of shredded paper, or other cellulose material;

2.5 grams of aluminum; and 2.0 grams of sulfur.

In a more detailed feature of the invention, the pyrotechnic patty includes a nichrome wire or a palladium coated aluminum wire for controllably igniting the patty when it is connected to the current source. Nichrome wire is a cost effective ignition source.

In another embodiment of the present invention, the pavement marker, an adhesive pad, and pyrotechnic patty are formed into a sandwich, with the adhesive pad preattached between the pavement marker and the pyrotechnic patty. The sandwich is particularly suitable for use in an automatic marker attachment system.

The pavement marker is attached to the paved surface by placing the sandwich, which includes the highway marker, the adhesive pad and the pyrotechnic patty, over a location on the paved surface at which the pyrotechnic patty is to be attached. The pyrotechnic patty is ignited which causes it to deflagrate and produce sufficient heat to melt the adhesive pad. After the pyrotechnic patty has burnt out, moderate pressure is applied to a top surface of the pavement marker while the adhesive is still melted so that the adhesive contacts both the bottom surface of the pavement marker and the paved surface. The adhesive is allowed to cool resulting in the pavement marker being permanently attached to the paved surface by the adhesive. To minimize the residual ash, the sandwich may be placed so that there is a small gap between the pyrotechnic patty and the paved surface to allow the residual ash to be ejected during deflagration of the patty.

Other features and advantages of the present invention should become apparent from the following description of the preferred embodiments, taken in conjunction with the accompanying drawings, which illustrate, by way of example, the principles of the invention.

DESCRIPTION OF THE PREFERRED EMBODIMENTS

Figure 1:
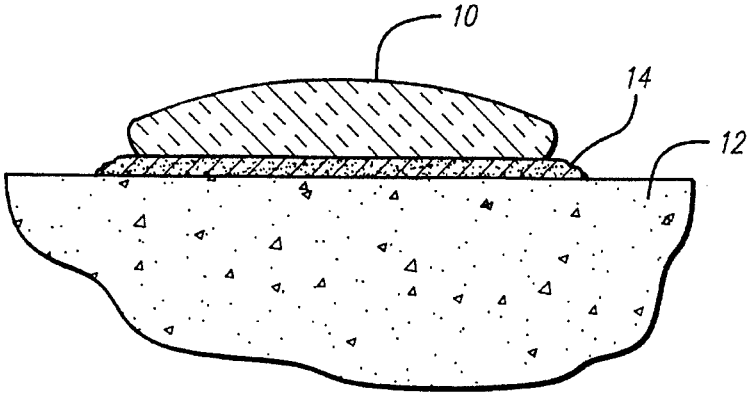
FIG. 1 PRIOR ART
FIG. 1 is a cross-sectional elevation view of a "Bott's Dot" style raised pavement marker, attached to a paved concrete roadway surface using bitumen as known in the prior art.
Figure 2:
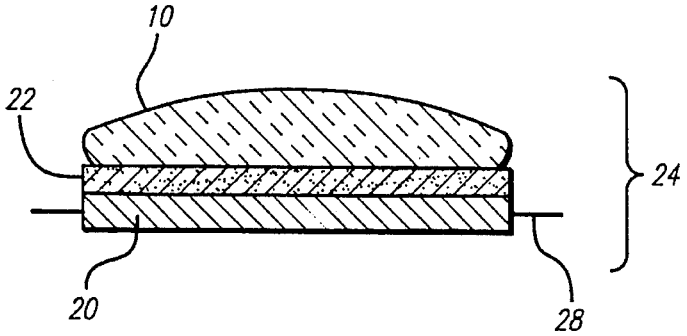
FIG. 2 is a cross-sectional elevational view of a first embodiment of a pyrotechnic patty of the present invention, with an associated ignition wire, for melting an adhesive pad to install a raised pavement marker.
Figure 3:
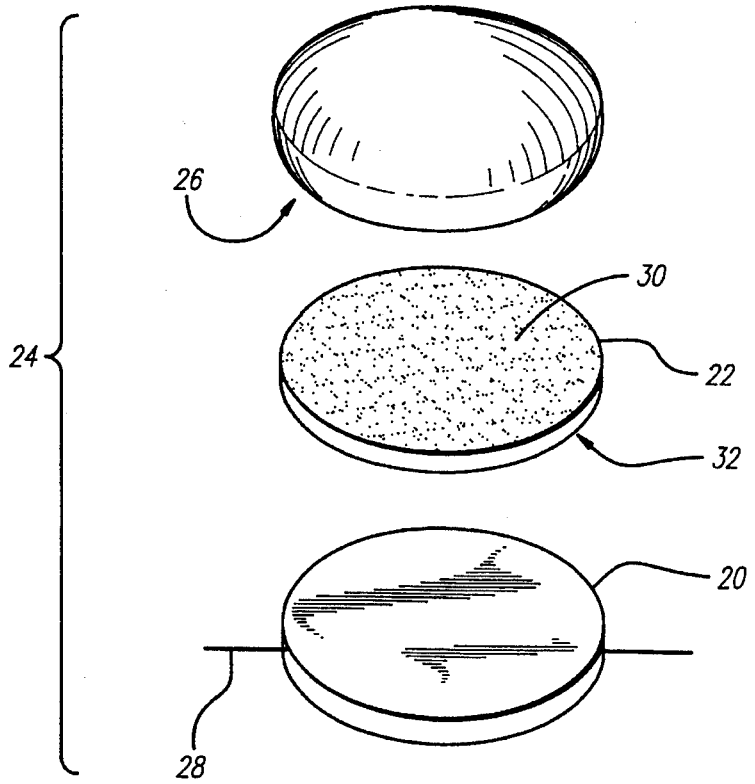
FIG. 3 is an exploded perspective view of the pyrotechnic patty, adhesive pad, and pavement marker shown in FIG. 2.

As shown in the exemplary drawings, and particularly in FIGS. 2 and 3, the present invention is embodied in a pyrotechnic patty 20 that can be deflagrated to melt an adhesive pad 22 for rapid attachment of a pavement marker 10 to a paved surface 12. The melted adhesive pad, after cooling and solidifying, permanently attaches the pavement marker to the paved surface.

The pyrotechnic patty 20 consists of a stable mixture of oxidizer and fuel formed into a fattened shape that, once ignited, deflagrates rapidly and produces a large amount of heat. The pavement marker 10 is installed by forming a sandwich 24 of the pavement marker, the adhesive pad 22, and the pyrotechnic patty and by then placing the sandwich over the location on the paved surface 12 at which the marker is to be attached, with a slight downward pressure to the top of the pavement marker. The pyrotechnic patty is ignited and deflagrates, to rapidly produce sufficient heat to melt the adhesive pad. After the pyrotechnic patty has burned completely, sufficient downward pressure is applied to the top of the pavement marker, to insure that the melted adhesive firmly contacts both the pavement marker and the roadway surface, and the adhesive is allowed to cool.

The resulting bond between the pavement marker 10 and the paved surface 12 is comparable to the bond provided by the prior art techniques. Generally, the bond should have sufficient shear strength to withstand a shear force of over 4,450N (1,000 lb.) at room temperature.

The pyrotechnic patty 20 for installing a "Bott's Dot" type pavement marker 10 preferably has a diameter of approximately 3½ inches and a thickness of roughly between ⅛ and ¼ inch. Selection of the oxidizer's constituents and the fuel's constituents, along with the pyrotechnic patty's shape and degree of confinement, largely determines the patty's properties relating to ignitability, burn rate, burn temperature and residual ash.

Difficult ignition affects the pyrotechnic patty's ease of use and reliability, while easy ignition gives rise to concerns regarding the patty's safety. Also, an unduly fast burn rate can cause melted adhesive to be spewed out from under the pavement marker 10, resulting in possible adhesion problems. Conversely, an unduly slow burn rate slows the marker's installation rate. Further, excessive residual ash can affect the adhesion between the adhesive pad and the paved surface 12, resulting in an attachment of the pavement marker with inadequate shear strength.

The adhesive pad 22 preferably is formed of bitumen and is shaped to be consistent with the size and shape of the bottom surface 26 of the pavement marker. In the case of a "Bott's Dot" style pavement marker, the pad preferably has a disk-like shape with a diameter just under 4 inches and a thickness of approximately 3/16 inches. In addition, the pad preferably is preattached to the bottom surface of the pavement marker.

A nichrome wire 28 is provided for controllably igniting the pyrotechnic patty 20. The nichrome wire runs through the center of the disk in a plane parallel to the patty's flat surfaces 30 and 32. The nichrome wire has a diameter of approximately 0.010 inches and a length of approximately 10 inches.

Various other ignition sources can be used for controllably igniting the pyrotechnic patty 20. A desirable, yet costly, ignition source is palladium-coated aluminum wire "PYROFUSE", available from Pyrofuze Corporation of Mount Vernon, New York. Palladium-coated aluminum wire has the desirable property of igniting and liberating large quantities of heat when triggered by a small electric current. Unfortunately, the cost of palladium-coated aluminum wire currently is several dollars per foot, which adds substantially to the cost of each patty. Fortunately, nichrome heating wire 28 provides a cost-effective ignition source that costs only a few cents per foot. Other suitable ignition methods include spark, microwave, induction or simple flame ignition.

One effective mixture of constituents for the pyrotechnic patty 20, based on empirical testing, has been found to be, by weight:

| | | |
|---|---|---|
| Potassium Nitrate | ($KNO_3$) | 1.5 grams |
| Ammonium Nitrate | ($NHNO_3$) | 7.0 grams |
| Shredded Newspaper | ($C_6H_{10}O_5$) | 4.8 grams |
| Aluminum | (Al) | 2.5 grams |
| Sulfur | (S) | 2.0 grams |

The oxidizer constituents are proportioned to achieve the desired operational characteristics. More specifically, the potassium nitrate exhibits good and reliable ignition characteristics, but tends to produce excessive ash during deflagration. Conversely, the ammonium nitrate deflagrates with minimal ash, but tends to be difficult to ignite. Thus, the mixture of approximately 5:1 ammonium nitrate to potassium nitrate proves to be an oxidizer mixture that is reliably ignitable and that produces a low amount of residual ash.

The principal fuel constituent is shredded newspaper. A wide variety of organic compounds could be used in place of the shredded newspaper. However, after testing various papers, cottons, starches, etc., shredded newspaper was chosen as an acceptable fuel that can be economically obtained and readily formed into a disk-like shape.

The aluminum and sulfur also are considered fuels and function to regulate the burn rate and temperature. The aluminum preferably is in powder form. Although insoluble, the aluminum and sulfur can be uniformly mixed with the shredded newspaper.

The mixture for the pyrotechnic patty 20, discussed above, was empirically determined by tests using a flat plate fixture (not shown). In each test, the pyrotechnic patty was placed between two spaced-apart aluminum disks that model the pavement marker and the roadway surface. Nichrome wire 28 was used to ignite the test patties. If a patty failed to properly ignite using the nichrome wire, a flame from a safety match was used as the ignition source. The following table provides representative data obtained in tests using the flat plate fixture:

| No. | I $KNO_3$ | II $NHNO_3$ | III NP | IV Al | V S | VI wt | VII temp | VIII burn | IX ash | X % |
|---|---|---|---|---|---|---|---|---|---|---|
| 1 | 1.50 | 5.00 | 4.8 | 2.39 | 2.24 | 15.56 | 295 | 24 | 4.50 | 29 |
| 2 | 1.50 | 5.00 | 4.8 | 2.39 | 2.24 | 14.84 | 284 | 20 | 4.26 | 29 |

-continued

| No. | I $KNO_3$ | II $NHNO_3$ | III NP | IV Al | V S | VI wt | VII temp | VIII burn | IX ash | X % |
|---|---|---|---|---|---|---|---|---|---|---|
| 3 | 1.50 | 5.00 | 4.8 | 2.39 | 2.24 | 15.48 | 287 | 22 | 4.35 | 28 |
| 4 | 1.50 | 5.00 | 4.8 | 2.39 | 2.24 | 15.24 | 287 | 30 | 4.54 | 30 |
| 5 | 1.50 | 7.00 | 4.8 | 2.39 | 2.24 | 17.39 | 164 | 15 | 2.72 | 16 |
| 6 | 1.50 | 7.00 | 4.8 | 2.39 | 2.24 | 17.24 | 187 | 20 | 3.68 | 21 |
| 7 | 1.50 | 7.00 | 4.8 | 2.39 | 2.24 | 17.28 | 131 | 23 | 4.03 | 23 |
| 8 | 2.00 | 7.00 | 4.8 | 2.39 | 2.24 | 18.03 | 201 | 12 | 3.19 | 18 |
| 9 | 2.50 | 7.00 | 4.8 | 2.39 | 2.24 | 18.46 | 210 | 13 | 3.61 | 20 |
| 10 | 3.00 | 7.00 | 4.8 | 2.39 | 2.24 | 19.00 | 229 | 10 | 3.90 | 21 |
| 11 | 3.25 | 7.00 | 4.8 | 2.39 | 2.24 | 19.10 | 170 | 15 | 4.43 | 23 |
| 12 | 3.50 | 7.00 | 4.8 | 2.39 | 2.24 | 19.03 | 157 | 14 | 4.43 | 23 |
| 13 | 1.50 | 7.00 | 4.8 | 2.39 | 1.00 | 16.14 | 266 | 95 | 4.61 | 29 |
| 14 | 1.50 | 7.00 | 4.8 | 2.39 | 1.25 | 16.58 | 179 | 16 | 4.18 | 25 |
| 15 | 1.50 | 7.00 | 4.8 | 2.39 | 1.50 | 16.79 | 182 | 4 | 4.00 | 24 |
| 16 | 1.50 | 7.00 | 4.8 | 2.39 | 1.75 | 16.98 | 211 | 4 | 3.95 | 23 |
| 17 | 1.50 | 7.00 | 4.8 | 2.39 | 2.00 | 17.14 | 181 | 10 | 3.05 | 18 |
| 18 | 1.50 | 7.00 | 4.8 | 1.75 | 2.00 | 16.74 | 188 | 21 | 4.03 | 24 |
| 19 | 1.50 | 7.00 | 4.8 | 2.00 | 2.00 | 17.22 | 149 | 10 | 3.91 | 23 |
| 20 | 1.50 | 7.00 | 4.8 | 2.50 | 2.00 | 17.61 | 141 | 11 | 3.68 | 21 |
| 21 | 1.50 | 7.00 | 4.8 | 2.75 | 2.00 | 17.78 | 156 | 11 | 3.69 | 21 |
| 22 | 1.50 | 7.00 | 4.8 | 3.00 | 2.00 | 18.00 | 150 | 8 | 3.93 | 22 |

The first five numbered columns indicate the respective constituent's weight in grams (NP represents newspaper). The sixth column, labeled "wt," indicates the respective patty's actual total weight, in grams, before ignition. A comparison of the first five columns and the sixth column indicates that a minor amount of the pyrotechnic patty 20 was lost in processing and handling of the patty. The seventh column, labeled "temp," indicates the test fixture's total temperature rise above the ambient temperature, in degrees Fahrenheit. The eighth column, labeled "burn," indicates the time, in seconds, from the patty's ignition to its burnout. The ninth column, labeled "ash," indicates the weight, in grams, of the residue ash. The last column indicates the percent, by weight, of the residue ash over the patty's initial weight.

A "best guess" as to the reaction involved in the combustion of the potassium nitrate and ammonium nitrate with the sulfur, aluminum and newspaper is as follows:

$$0.015\ KNO_3 + 0.0875\ NH_4NO_3 + 0.030\ C_6H_{10}O_5 + 0.063\ S + 0.093\ Al \rightarrow 0.0315\ Al_2O_3 + 0.088\ NH_3 + 0.0075\ K_2O + 0.021\ CO + 0.063\ SO_2 + 0.159\ C + 0.193\ H_2O + 0.051\ N_2$$

The shredded paper is indicated as a general cellulose. The gaseous and evaporated-liquid reaction products are dispersed into the atmosphere, while the solid reaction products remain as residual ash. Since excessive residual ash interferes with the bond between the bitumen 22 and the paved surface 12, the mixture, discussed above, also produces a relatively small amount of residual ash. A limited amount of residue ash can actually improve the bond, by reinforcing the bond if the ash is uniformly distributed throughout the melted bitumen. Alternatively, tests show that a large percentage of the residual ash is ejected by the intensity of the burn if the pyrotechnic patty 20 is held slightly above the paved surface, with a small gap, during ignition.

The pyrotechnic patty 20 can be fabricated by a variety of methods. A uniform mixture of the constituents within the pyrotechnic patty is desired for predictability and reliability. A dry blend of the patty's constituents failed to provide a patty with sufficient strength for handling. Blending the constituents with excess water, and then removing the water, results in a patty, when dried, with the color, consistency and strength of "egg carton" type material. Before removing the excess water, the mixture is formed into the desired shape. Since the potassium nitrate and ammonium nitrate are soluble in water, especially at elevated temperatures, oven drying of the patty should be avoided since migration of the solutes can occur during the drying process, resulting in a nonuniform distribution of the solutes in the patty. Although not yet attempted, freeze drying the patty should avoid any possible problems with solute migration.

In an alternative method of fabricating the pyrotechnic patty 20, the constituents are blended with an excess of water. The excess water is then removed from the patty using a Buchner funnel. Obviously some of the dissolved solutes are removed with the excess water. Since solubility is generally a function of temperature, the amount of solutes retained in the patty is adjusted by varying the temperature at which the evacuation takes place and by dissolving an excess of potassium nitrate and ammonium nitrate in the water. Thus, in this method, an excess amount of potassium nitrate and ammonium nitrate is dissolved in warm water. Upon cooling, much of the potassium nitrate and ammonium nitrate precipitate out into the paper and are retained in the patty after the water is evacuated. External cooling is generally unnecessary, because the blending of the nitrate salts in water forms a brine which immediately drops the mixture's temperature significantly.

Using this method, the resulting pyrotechnic patty 20 is structurally rigid and only slightly damp just a few minutes after applying vacuum to remove the water. The evacuated nitrate-saturated water is recycled by measuring and adjusting the solution for the next patty or, in large-scale production, batch of patties.

For fabricating the pyrotechnic patties 20 used in the flat-plate test, discussed above, a fabrication method was developed to arrive at particular desired percentages of the different solubles without extensive trial and error testing. The newspaper, sulfur and aluminum, which are insoluble, were mixed with water and then oven dried to form a dry patty, as mentioned before, having the consistency and strength of egg carton type material. The dry patty was then used to soak up the proper proportions of ammonium nitrate and potassium nitrate dissolved in a minimum amount of water. The damp patty was slowly oven dried at a moderate temperature. This procedure allowed relatively easy fabrication of patties of different compositions with the desired constituent proportions.

Figure 4:
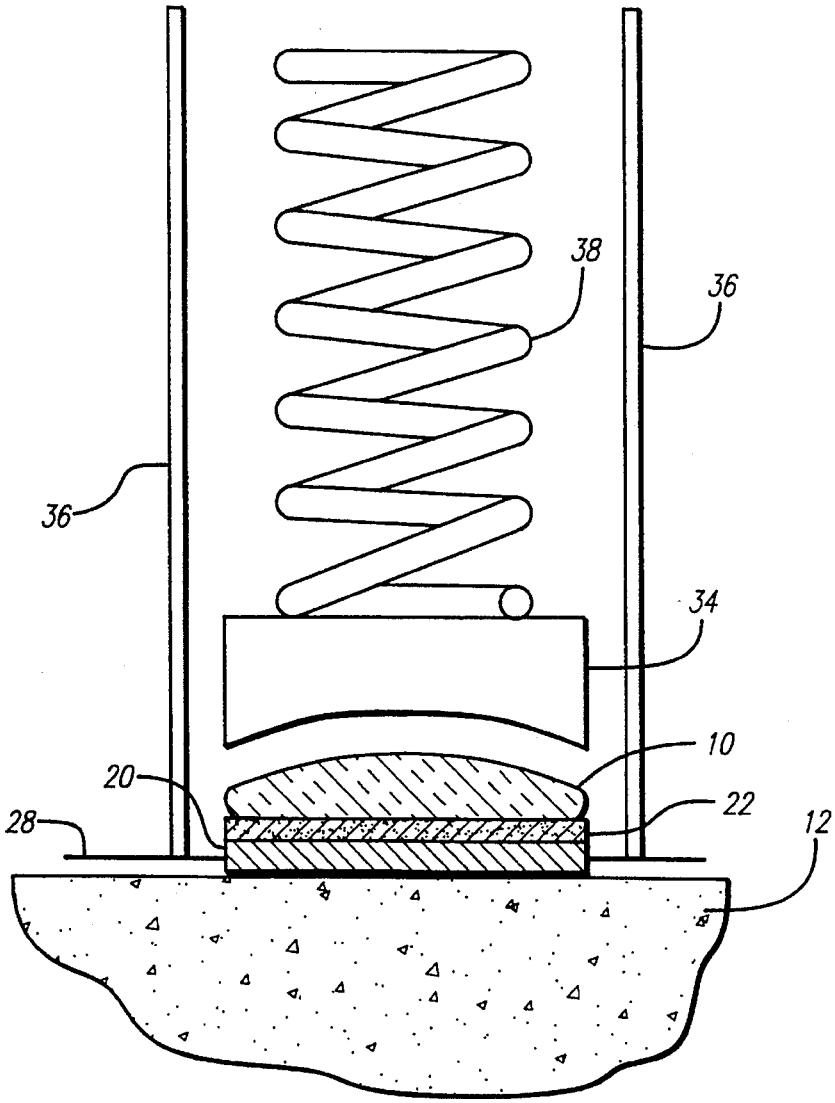
FIG. 4 is a side view of an apparatus for securing and providing an ignition current to the pyrotechnic patty, shown in FIG. 2, during installation of the pavement marker.

As shown in FIG. 4, the pyrotechnic patty 20 of the present invention is particularly suited for automatic installation of pavement markers. A fixture 34 engages the top surface of the pavement marker 10 and holds the pavement marker in place over the paved surface 12. Two electrodes 36, providing an ignition current, are placed in contact with the two ends, respectively, of the nichrome wire 28. The ignition current is increased until the nichrome wire glows red hot and ignites the pyrotechnic patty, which usually occurs at a current of about 2 amperes. Just after the pyrotechnic patty has burned out, a downward pressure is applied through the spring 38 to the pavement marker, while the bitumen is still melted, to insure that the bitumen provides a firm bond between the pavement marker and the roadway surface.

In the preferred embodiment, a sandwich 24 (FIGS. 2 and 3) is formed of the pavement marker 10, the bitumen pad 22, and the pyrotechnic patty 20. The bitumen pad is factory attached to the pavement marker by heating the bitumen pad until its top surface, which is to be attached to the marker, is sufficiently melted and the bitumen pad's melted surface is then applied to the marker's bottom surface 26. Thus, after cooling, the bitumen pad is secured to the pavement marker. Similarly, to attach the pyrotechnic patty to the sandwich, the bitumen pad is heated until its bottom surface 32 is slightly melted and the pyrotechnic patty is then applied to the melted surface. After the bitumen pad cools, the pyrotechnic patty is sufficiently secured to the sandwich for automated handling.

Figure 5:
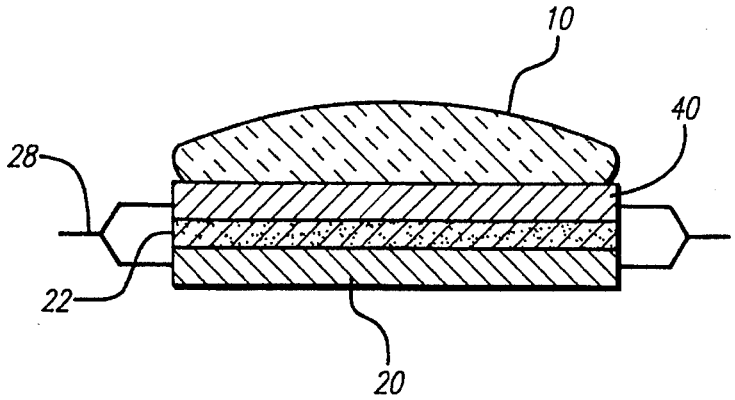
FIG. 5 is a cross-sectional elevational view of a second embodiment of the present invention, showing an additional pyrotechnic patty for adhering the adhesive pad to the pavement marker.

In an alternative embodiment, shown in FIG. 5, the pavement marker 10 is not preattached to the adhesive pad 22. Accordingly, an additional pyrotechnic patty 40 is placed between the bitumen and the pavement marker. The ignition wires 28 for both pyrotechnic patties are connected together. Thus, both patties are simultaneously ignited. The second pyrotechnic patty insures that the adhesive adjacent the relatively cool pavement marker is thoroughly melted, to provide a secure bond between the pavement marker and the paved surface 12.

Although the foregoing discloses the presently preferred embodiments of the present invention, it is understood that those skilled in the art may make various changes to the preferred embodiments shown without departing from the scope of the invention. The invention is defined only by the following claims.

I claim:

1. A pyrotechnic patty for attaching a pavement marker to a roadway surface by heating an adhesive pad, comprising:

one or more oxidizers; and one or more fuels;

wherein the oxidizer and the fuel are blended and formed into a relatively flat patty, and the compositions and amounts of the oxidizers and fuels are selected such that, upon ignition, the patty is effective in melting the adhesive pad and producing a sufficiently low amount of residual products so that the pavement marker is adequately attached to the roadway surface.

2. A pyrotechnic patty as defined in claim 1, wherein:

the oxidizers comprise ammonium nitrate and potassium nitrate; and the fuels comprise cellulose material, aluminum, and sulfur.

3. A pyrotechnic patty as defined in claim 2, wherein the cellulose material is shredded paper.

4. A pyrotechnic patty as defined in claim 1, wherein the oxidizers and the fuels are comprised of the following constituents, in approximate weights:

1.5 grams of potassium nitrate;

7.0 grams of ammonium nitrate;

4.8 grams of shredded paper;

2.5 grams of aluminum; and 2.0 grams of sulfur.

5. A pyrotechnic patty as defined in claim 1, further comprising an igniter for controllably igniting the patty.

6. A pyrotechnic patty as defined in claim 5, wherein the igniter is a nichrome wire adapted to be controllably connected to a current source so that the nichrome wire ignites the fuels and oxidizers when it is connected to the current source.

7. A pyrotechnic patty as defined in claim 5, wherein the igniter is a palladium-coated aluminum wire adapted to be controllably connected to a current source so that the nickname wire ignites the fuels and oxidizers when it is connected to the current source.

8. A pyrotechnic patty as defined in claim 1, further comprising one or more constituents that functions as temperature and burn rate modifiers.

9. Apparatus for pyrotechnic installation on a roadway surface, comprising:

a pavement marker having a flat bottom surface and a raised top surface;

an adhesive pad that melts when heated to a predetermined temperature, the adhesive pad having substantially flat top and bottom surfaces, wherein the top surface of the adhesive pad is attached to the bottom surface of the pavement marker; and a flattened pyrotechnic patty having a top surface and a bottom surface, and including at least one oxidizer and at least one fuel, wherein the top surface of the pyrotechnic patty is attached to the bottom surface of the adhesive pad.

10. Apparatus for pyrotechnic installation as defined in claim 9, wherein:

the adhesive pad is formed of bitumen; and the pyrotechnic patty comprises ammonium nitrate, potassium nitrate, cellulose material, aluminum, and sulfur, which are blended in sufficient amounts and such that, upon ignition, the patty is effective in melting the adhesive pad and producing a sufficiently low amount of residual ash so that the pavement marker is adequately attached to the roadway surface.

11. A highway lane marker as defined in claim 10, wherein the pyrotechnic patty further comprises a nichrome wire for controllably igniting the pyrotechnic patty.

12. Apparatus as defined in claim 9, wherein the pyrotechnic patty is comprised of a blend of the following constituents, in approximate weights:

1.5 grams of potassium nitrate;

7.0 grams of ammonium nitrate;

4.8 grams of shredded paper;

2.5 grams of aluminum; and 2.0 grams of sulfur.

13. A method for attaching a pavement marker to a roadway surface, comprising:

providing an adhesive pad that melts at a predetermined temperature;

providing a pyrotechnic patty that, when ignited, rapidly produces heat sufficient to melt the adhesive pad;

placing a sandwich comprising the pavement marker, the adhesive pad and the pyrotechnic patty over a location on the roadway surface to which the pavement marker is to be attached;

igniting the pyrotechnic patty to cause it to deflagrate and produce sufficient heat to melt the adhesive pad;

applying pressure to a top surface of the pavement marker while the adhesive is still melted so that the adhesive contacts both a bottom surface of the pavement marker and the roadway surface;

allowing the adhesive to cool so that the pavement marker is firmly attached, by the adhesive, to the roadway surface.

14. A method for attaching a pavement marker as defined in claim 13, wherein the adhesive comprises bitumen.

15. A method for attaching a pavement marker as defined in claim 13, wherein the step of placing the sandwich over a location on the roadway surface includes providing a small gap between the pyrotechnic patty and the roadway surface to allow residual ash to be ejected during deflagration of the patty.

* * * * *